US006578379B2

(12) United States Patent
Paradowski

(10) Patent No.: US 6,578,379 B2
(45) Date of Patent: Jun. 17, 2003

(54) PROCESS AND INSTALLATION FOR SEPARATION OF A GAS MIXTURE CONTAINING METHANE BY DISTILLATION

(75) Inventor: Henri Paradowski, Cergy (FR)

(73) Assignee: Technip-Coflexip, Courbevoie (FR)

( * ) Notice: Subject to any disclaimer, the term of this patent is extended or adjusted under 35 U.S.C. 154(b) by 28 days.

(21) Appl. No.: 10/013,838

(22) Filed: Dec. 13, 2001

(65) Prior Publication Data

US 2002/0095062 A1 Jul. 18, 2002

(30) Foreign Application Priority Data

Dec. 13, 2000 (FR) ..... 00 16238

(51) Int. Cl.[7] ..... F25J 3/00
(52) U.S. Cl. ..... 62/622; 62/628
(58) Field of Search ..... 62/622, 628, 657

(56) References Cited

U.S. PATENT DOCUMENTS 4,155,729 A 5/1979 Gray et al.
4,278,457 A 7/1981 Campbell et al.
4,356,014 A * 10/1982 Higgins ..... 62/622
4,456,461 A * 6/1984 Perez ..... 62/622
4,549,890 A * 10/1985 Bligh ..... 62/622
4,666,483 A * 5/1987 Gauthier ..... 62/622
4,702,819 A 10/1987 Sharma et al.
5,566,554 A 10/1996 Vijayaraghavan et al.
5,568,737 A 10/1996 Campbell et al.
5,602,293 A 2/1997 Bauer

FOREIGN PATENT DOCUMENTS

EP 1 114 808 7/2001

* cited by examiner

*Primary Examiner*—Ronald Capossela
(74) *Attorney, Agent, or Firm*—Leydig, Voit & Mayer, Ltd.

(57) ABSTRACT

A process and apparatus for separation of a gas mixture. A process and an installation for cryogenic separation of the constituents of a natural gas under pressure in a first phase separator in which the constituents of each phase are separated in a distillation column. Part of the gaseous fraction from the top of the column is recycled into the highest stage of the column. The process also includes branching of part of a first top fraction from the first phase separator. The process also includes separation of a first bottom fraction from the first separator, in a second separator.

12 Claims, 2 Drawing Sheets

Figure 1:
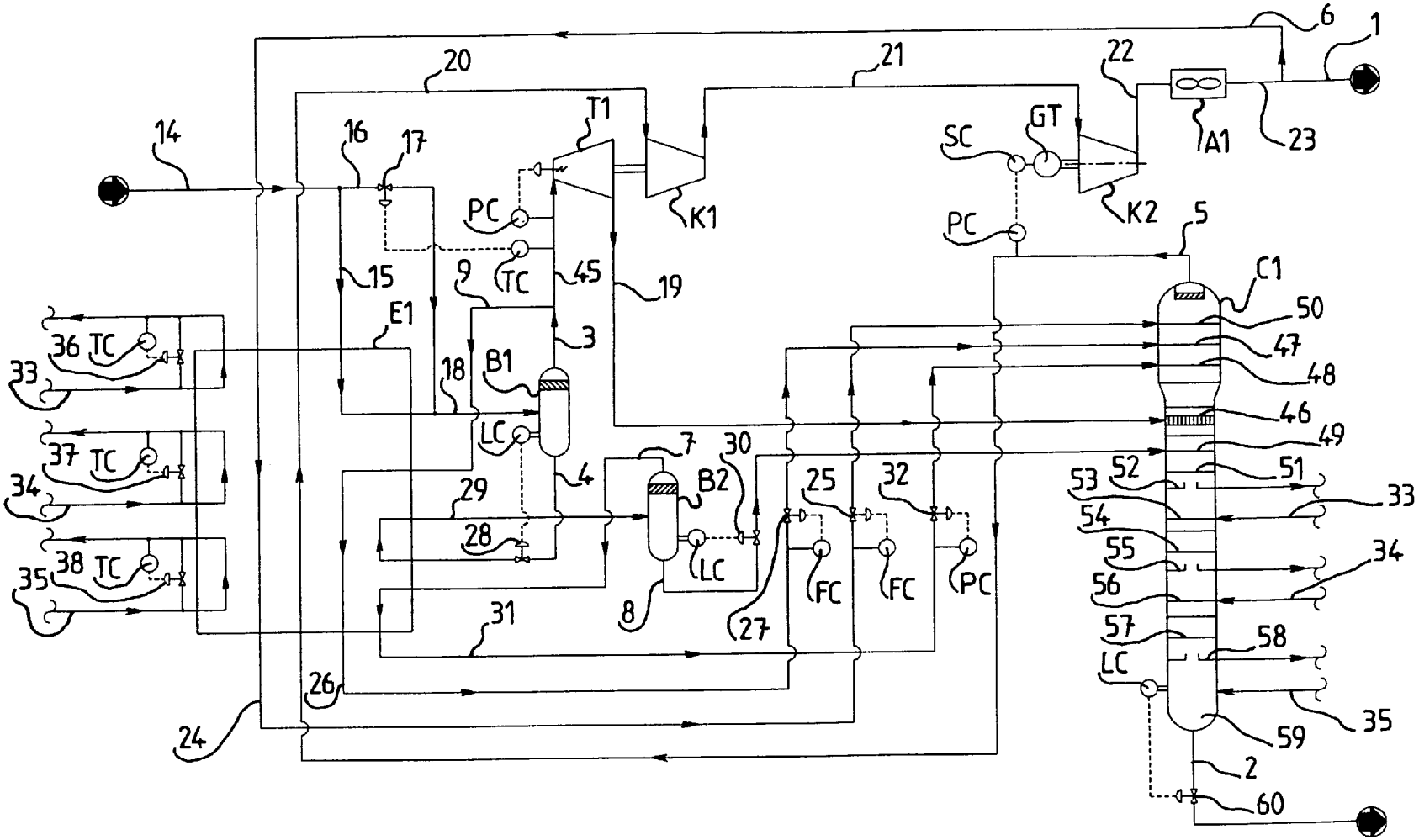

PROCESS AND INSTALLATION FOR SEPARATION OF A GAS MIXTURE CONTAINING METHANE BY DISTILLATION

FIELD OF THE INVENTION

This invention concerns, in general and according to one of its aspects, a separation process making it possible to separate the constituents of natural gas into a first gas fraction which is rich in methane and essentially depleted of $C_2$ and higher hydrocarbons, and a second gas fraction, which is rich in $C_2$ and higher hydrocarbons and essentially methane-depleted.

A process of the kind to which the invention is directed is known in the prior art as shown by U.S. Pat. No. 5,881,569.

Ethane contained in natural gas can be extracted with known processes, as described in U.S. Pat. Nos. 4,140,504; 4,157,904; 4,171,964; and 4,278,547. Although the processes described in these patents are of interest, in practical terms they allow, at best, an ethane recovery rate of about 85%. They use liquid/gas separators, heat exchangers, pressure reducers (usually in the form of turbines), compressors, and distillation columns.

More recently, other processes have been made public, particularly by U.S. Pat. Nos. 4,649,063; 4,854,955; 5,555,748; and 5,568,737. Although these more recent processes can result in relatively satisfactory extraction yields of ethane and other hydrocarbons, in order to obtain fractions rich in methane or $C_2$ and higher hydrocarbons, these processes require relatively substantial energy consumption.

SUMMARY OF THE INVENTION

In view of this, the present invention is designed to reduce energy consumption in the production of fractions rich in methane or $C_2$ and higher hydrocarbons, while maintaining much higher extraction yields than the processes of the prior art.

The invention concerns, according to one aspect, a process for separation of a mixture that is cooled under pressure and that contains methane, $C_2$, and higher hydrocarbons, into a final light fraction rich in methane and a final heavy fraction rich in $C_2$ and higher hydrocarbons, comprising a first stage in which the cooled mixture is separated under pressure in a first flask, into a first top fraction which is relatively more volatile, and a first bottom fraction which is relatively less volatile, in which the first bottom fraction is introduced into the middle part of a distillation column in which there is collected, in a lower part of the column, as a second bottom fraction, the final heavy fraction rich in $C_2$ and higher hydrocarbons, in which there is introduced, after it has been reduced in pressure in a turbine, the first top fraction in an upper part of the distillation column, in which there is collected, in the upper part of the column, a second top fraction rich in methane, in which the second top fraction is then subjected to compression and cooling to obtain the final light fraction, and in which a first sample fraction is taken from the final light fraction, this process including a second stage in which the first sample fraction is introduced, after cooling and liquefaction, into the upper part of the distillation column.

The process of the invention, includes a third stage in which the first bottom fraction is subjected to a number of sub-stages including reheating, passage into a second flask, and separation into a third top fraction which is relatively more volatile and a third bottom fraction which is relatively less volatile, in which the third bottom fraction is introduced into the middle part of the distillation column, and in which the third top fraction, after cooling and liquefaction, is introduced into the upper part of the distillation column.

Another process, as described in U.S. Pat. No. 5,566,554, uses two liquid/gas separators, of which a liquid fraction collected at the bottom of the first separator is heated then introduced into a second separator. This technique makes it possible, in particular, to improve the extraction of the methane contained in the bottom fraction from the first separator, and especially to use the pressure reduction of this bottom fraction to cool the natural gas stream to be treated which is entering the installation, in a heat exchanger.

On the other hand, this known process cannot be used to obtain extensive extraction of ethane, because the quantity of reflux generated by the technique is low, and the ethane content of this reflux is relatively high.

The present invention overcomes these problems by two means.

First, the invention provides for diversion of part of the methane-rich fraction at the top of the column and its reintroduction into the last stage of the column after compression and cooling. This makes it possible to obtain a reflux in sufficient quantity and of excellent quality, as the $C_3$ content is very low, for example, less than 0.1 mol %.

Second, the invention provides for diversion to the column of part of the first top fraction from the first separator before the stage of pressure reduction in the turbine. This second diverted fraction is cooled and liquefied before it is introduced into the column. This method of proceeding limits the quantity of recycle and liquefied gas mentioned above and reduces the related compression costs.

The invention may also provide for removing a second sample fraction from the top fraction, and introducing this second sample fraction, after cooling and liquefaction, into the top of the distillation column.

According to one possible embodiment of the invention, the second sample fraction is cooled and partly condensed, then separated in a third flask into a fourth relatively more volatile top fraction, which is cooled and liquefied, then introduced into the upper part of the distillation column, and into a fourth relatively less volatile bottom fraction, which is heated, then separated in a fourth flask into a fifth relatively more volatile top fraction which is cooled and liquefied, then introduced into the upper part of the distillation column, and a fifth relatively less volatile bottom fraction which is heated and then sent into the second flask.

The invention may also provide that the lower part of the distillation column should comprise a number of stages connected in pairs to one or more lateral reboilers.

The invention may also provide that, to obtain the final light fraction, after the second top fraction leaves the distillation column, the latter undergoes reheating, a first compression in a first compressor connected to the pressure reduction turbine, a second compression in a second compressor, and cooling.

The invention may also provide that the upper part of the distillation column also comprises at least two successive stages, the first of which is the lowest, and that the fifth top fraction be introduced above the first stage.

The invention may further provide that the upper part of the distillation column comprise at least three successive stages, the first of which is the lowest, and that the fifth top fraction be introduced above the second stage.

The invention may also provide that the upper part of the distillation column comprise at least two successive stages, the first of which is the lowest, and that the second sample fraction be introduced above the first stage.

The invention may also provide that the upper part of the distillation column comprise at least three stages, the first of which is the lowest, into which the first sample fraction is introduced in a lower part of the first stage, and that the third top fraction be introduced below the last stage.

Finally, the invention may provide that the third top fraction be introduced into the first stage of the upper part of the distillation column.

The invention may also provide that the middle part of the distillation column comprise at least two successive stages, the first of which is the lower, and in which the first bottom fraction is introduced at least into the first stage, and that the first top fraction is introduced above the first stage.

According to a second aspect, the invention concerns a methane-rich gas obtained by the present procedure, as well as a liquefied gas which is rich in $C_2$ and higher hydrocarbons, obtained by the present process.

According to a third aspect, the invention concerns an installation for separation of a cooled mixture under pressure containing methane and $C_2$ and higher hydrocarbons, into a final light methane-rich fraction and a final heavy fraction rich in $C_2$ and higher hydrocarbons, comprising means to carry out a first stage in which the mixture cooled under pressure is separated, in a first flask, into a relatively more volatile first top fraction and a relatively less volatile first bottom fraction, in which the first bottom fraction is introduced into a middle part of a distillation column, in which the final heavy fraction rich in $C_2$ and higher hydrocarbons is collected in the lower part of the column as the second bottom fraction, and in which there is introduced the first top fraction into an upper part of the distillation column, after it has undergone pressure reduction in a turbine; in which a second methane-rich top fraction is collected in the upper part of this column, in which the second top fraction then undergoes compression and cooling to obtain the final light fraction, and in which a first sample fraction is removed from the final light fraction; this installation comprising means to carry out a second stage in which the first sample fraction is introduced, after cooling and liquefaction, into the upper part of the distillation column, this installation comprising means to carry out a third stage in which the first bottom fraction is subjected to a number of sub-stages including reheating, passage into a second flask, and separation into a third relatively more volatile top fraction, and a third relatively less volatile bottom fraction, in which the third bottom fraction is introduced into the middle part of the distillation column, and in which the third top fraction, after cooling and liquefaction, is introduced into the upper part of the distillation column.

Figure 2:
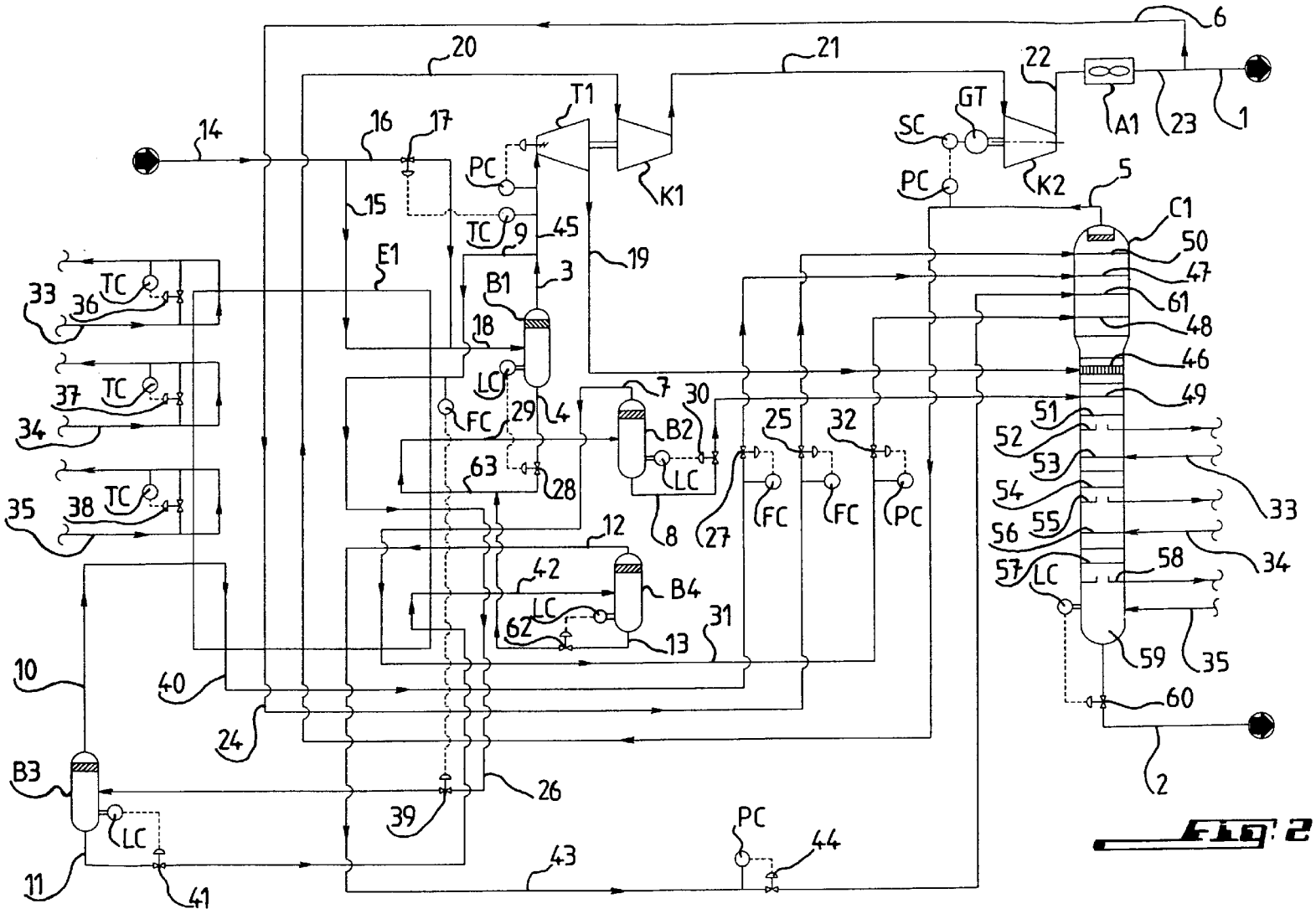

The invention can be better understood, and others of its goals, characteristics, details, and advantages will be more clear in the description to follow, with reference to the attached schematic diagrams, given only as non-limiting examples, and in which:

FIG. 1 represents a functional synoptic diagram of an installation according to one possible mode of embodiment of the invention; and FIG. 2 represents a functional synoptic diagram of an installation according to another preferred mode of embodiment of the invention.

These two figures carry the symbols "FC," flow control, "GT," gas turbine, "LC," liquid level control, "PC," pressure control, "SC," speed control, and "TC," temperature control.

For the sake of clarity and conciseness, the lines used in the installations of FIGS. 1 and 2 will be referenced by the same symbols as the gas fractions circulating through them.

DETAILED DESCRIPTION

With respect to FIG. 1, the installation represented is intended to treat a dry natural gas, particularly to isolate a fraction composed primarily of methane essentially free of $C_2$ and higher hydrocarbons on the one hand, and a fraction composed primarily of $C_2$ and higher hydrocarbons essentially free of methane, on the other hand.

Dry natural gas 14 is first separated into a fraction 15 which is cooled in a heat exchanger E1, and into a fraction 16 which is sent in a pipe. Circulation of the fraction 16 is regulated by a controlled valve 17, whose opening varies as a function of the temperature of a fraction 45. At the exit from exchanger E1, the fraction 15 is mixed with the fraction 16 to yield a cooled fraction 18. Fraction 18 is then introduced into a liquid/gas separation flask B1 in which this fraction 18 is separated into a relatively more volatile first top fraction 3 and a relatively less volatile first bottom fraction 4.

The first top fraction 3 undergoes pressure reduction in a turbine T1 to provide a pressure-reduced fraction 19 which is introduced into the middle part of a distillation column C1. Then, in a lower part of the distillation column C1, the final heavy fraction 2 rich in $C_2$ and higher hydrocarbons is collected as the second bottom fraction 2. This final heavy fraction 2 is transported into a pipe with a controlled opening valve 60 whose opening depends on the liquid level in the bottom of the column C1. Conversely, in an upper part of the distillation column C1, a second methane-rich top fraction 5 is collected. This second top fraction 5 is then heated in the heat exchanger E1 to provide the heated fraction 20, then it undergoes a first compression in a first compressor K1 coupled with the turbine T1 to provide a compressed fraction 21. The fraction 21 is then subjected to a second compression in a second compressor K2 which is powered by a gas turbine whose speed is regulated by a speed control mechanism governed by a pressure control mechanism connected to the line which carries the second top fraction 5, to provide another compressed fraction 22. This compressed fraction is then air-cooled in a heat exchanger A1 to provide a compressed and cooled fraction 23.

The fraction 23 is then divided into a first sample fraction 6 and a final methane-rich light fraction 1. The first sample fraction 6 is then cooled and liquefied in the heat exchanger E1 to provide a cooled fraction 24 which is carried in a pipe having a controlled valve 25 with flow-controlled opening, then it is introduced into the upper part of the distillation column C1.

A second sample fraction 9 is taken from the first top fraction 3 and is cooled and liquefied in the heat exchanger E1 to provide a cooled fraction 26. This fraction is carried in a pipe having a flow-controlled valve 27, and then is introduced into the upper part of the distillation column C1.

The first bottom fraction 4 is transported into a line which has a controlled valve 28 whose opening depends on the liquid level in the bottom of the separating flask B1. The first bottom fraction 4 is then heated in the exchanger E1 to provide a heated fraction 29. The fraction 29 is then introduced into a liquid/gas separating flask B2 to be separated into a third relatively more volatile top fraction 7, and a third relatively less volatile bottom fraction 8.

The third bottom fraction 8 is transported into a pipe which has a controlled valve 30 whose opening depends on the liquid level in the bottom of the separating flask B2. The third bottom fraction 8 is then introduced into the middle of the distillation column C1. The third top fraction 7 is cooled and liquefied in the exchanger E1 to provide a cooled fraction 31. This fraction is carried in a pipe having a valve 32 with pressure-controlled opening, and is then introduced into the distillation column C1.

The distillation column C1 comprises in its lower part several stages which are connected in twos by heating circuits 33, 34, and 35, which are connected individually to the heat exchanger E1. Each of these heating circuits constitutes a lateral reboiler. The temperature of the fluid circulation in each of the circuits 33, 34, and 35 is regulated with controlled-opening valves located on by-pass pipes which do not pass into the exchanger E1. The opening of these valves is controlled by temperature control mechanisms connected to the pipes. These control mechanisms, 36, 37, and 38, are positioned downstream from the fraction mixing zone after their passage into the exchanger E1 and/or the by-pass pipes.

With reference to FIG. 2, it is clear that most of the elements contained in FIG. 1 are also present in FIG. 2, with the exception of the addition of a circuit having two separation flasks.

Thus, as in the case of FIG. 1, the installation represented is designed to treat a dry natural gas, particularly to isolate from it a fraction composed primarily of methane essentially free of $C_2$ and higher hydrocarbons, on the one hand, and a fraction composed primarily of $C_2$ and higher hydrocarbons free of methane, on the other hand.

Dry natural gas 14 is then separated into a fraction 15 which is cooled in a heat exchanger E1, and a fraction 16 which is sent in a pipe. The circulation of the fraction 16 is regulated by a controlled valve 17 whose opening varies as a function of the temperature of a fraction 45. At the exit of the exchanger E1, the fraction 15 is mixed with the fraction 16 to yield a cooled fraction 18. The fraction 18 is then introduced into a liquid/gas separating flask B1 in which this fraction 18 is separated into a first relatively more volatile top fraction 3 and a first relatively less volatile bottom fraction 4. The first top fraction 3 undergoes pressure reduction in a turbine T1 to provide a pressure-reduced fraction 19, which is introduced into the middle of a distillation column C1. Then, in a lower part of the distillation column C1, the final heavy fraction 2 rich in $C_2$ and higher hydrocarbons is collected as the second bottom fraction 2. This final heavy fraction 2 is transported in a pipe having a valve with controlled opening 60 whose opening depends on the liquid level in the bottom of the column C1. In an upper part of the distillation column C1, a second methane-rich top fraction 5 is also collected. This second top fraction 5 is then heated in the exchanger E1 to provide a heated fraction 20, and then undergoes a first compression in a first compressor K1 coupled to the turbine T1 to provide a compressed fraction 21. The fraction 21 is then subjected to a second compression in a second compressor K2 powered by a gas turbine whose speed is regulated by a speed control device governed in turn by a pressure control device connected to the pipe carrying the second top fraction 5, to provide another compressed fraction 22. The latter is then air-cooled in a heat exchanger A1 to provide a cooled compressed fraction 23.

The fraction 23 is then divided into a first sample fraction 6 and a final methane-rich light fraction 1. The first sample fraction 6 is then cooled in the heat exchanger E1 to yield a cooled fraction 24 which is carried in a pipe having a valve 25 with flow-controlled opening, and is then introduced into the upper part of the distillation column C1.

A second sample fraction 9 is sampled from the top fraction 3, and it is cooled in the heat exchanger E1 to provide a cooled fraction 26. The latter is carried in a pipe which, unlike the one shown in FIG. 1, has a valve 39 with flow-controlled opening. The cooled fraction 26 is then introduced into a liquid/gas separating flask B3 to be separated into a fourth relatively more volatile top fraction 10, and a fourth relatively less volatile bottom fraction 11.

The fourth top fraction collected is then cooled in the exchanger E1 to yield a cooled liquefied fraction 40.

The cooled liquefied fraction 40 is then carried in a pipe having a valve 27 with flow-controlled opening, then it is introduced into the upper part of the distillation column C1.

The fourth bottom fraction 11 is transported in a pipe which has a controlled valve 41 whose opening depends on the liquid level in the bottom of the separating flask B3. The fourth bottom fraction 11 is then heated in the exchanger E1 to yield a heated fraction 42. This heated fraction 42 is separated in a fourth flask B4 into a fifth relatively more volatile top fraction 12 and a fifth relatively less volatile bottom fraction 13.

The fifth top fraction 12 is heated and liquefied in the exchanger E1 to produce a cooled liquefied fraction 43. This fraction is then transported in a pipe which has a valve 44 with pressure-controlled opening, and is then introduced into the upper part of the distillation column C1.

The fifth relatively less volatile bottom fraction 13 is transported in a pipe having a valve 62 whose opening is controlled by the liquid level in the flask B4.

The first bottom fraction 4 is transported in a pipe which has a controlled valve 28 whose opening depends on the liquid level in the bottom of the separating flask B1. The first bottom fraction 4 and the fifth bottom fraction 13 are then combined to yield a mixed fraction 63 which is heated in the exchanger E1 to provide a heated fraction 29. The fraction 29 is then introduced into a liquid/gas separating flask B2 to be separated into a third relatively more volatile top fraction 7 and a third relatively less volatile bottom fraction 8.

The third bottom fraction 8 is transported in a pipe which has a controlled valve 30 whose opening depends on the liquid level in the bottom of the separating flask B2. The third bottom fraction 8 is then introduced into the middle part of the distillation column C1. The third top fraction 7 is cooled and liquefied in the exchanger E1 to yield a cooled and liquefied fraction 31. This fraction is carried in a pipe having a valve 32 with pressure-controlled opening, and is then introduced into the distillation column C1.

There are several trays in the lower part of the distillation column C1; they are connected in pairs by heating circuits 33, 34, and 35, which are connected individually to the heat exchanger E1. Each of these heating circuits constitutes a lateral reboiler. The temperature of the fluid circulation in each of these circuits 33, 34, and 35 is regulated by valves with controlled opening, positioned on by-pass lines which do not pass into the exchanger E1. The opening of these valves is controlled by temperature control devices connected to the pipes. These control devices, 36, 37, and 38, are located downstream from the mixing zone of the fractions after the fractions pass into the exchanger E1 and/or the bypass lines.

The process of ethane extraction using an installation according to FIG. 1 permits more than 99% recovery of the ethane contained in a natural gas.

According to an operational model of the installation of FIG. 1, the charge of dry natural gas (14) at 24° C. and 62 bar, whose flow is 15,000 kmol/h, composed of 0.4998 mol % $CO_2$, 0.3499 mol % $N_2$, 89.5642 mol % methane, 5.2579 mol % ethane, 2.3790 mol % propane, 0.5398 mol % isobutane, 0.6597 mol % n-butane, 0.2399 mol % isopentane, 0.1899 mol % n-pentene, 0.1899 mol % n-hexane, 0.1000 mol % n-heptane, 0.0300 mol % n-octane, is cooled and partially condensed in the heat exchanger E1 to −42° C. and 61 bar to form the fraction 18. The liquid and gas phases are separated in the flask B1. The first top fraction 3, which has a flow of 13,776 kmol/h, is divided into two streams:

(a) the main stream 45, which has a flow rate of 11,471 kmol/h, undergoes pressure reduction in the turbine T1 to a pressure of 23.20 bar. The dynamic expansion makes it possible to recover 3087 kW of energy, and permits cooling of this stream to a temperature of −83.41° C. This stream 19, which is partially condensed, is sent to column C1. The stream 19 enters this column on a stage 46, which is the tenth stage starting from the highest stage of the column C1. Its entry pressure is 23.05 bar, and its temperature is −83.57° C.

(b) the secondary stream 9 of 2305 kmol/h, which is liquefied and cooled to −101.40° C. in the exchanger E1 to form the fraction 26. This fraction 26, which comprises 4.55 mol % ethane, undergoes pressure reduction to 23.20 bar to a temperature of −101.68° C., and is then introduced into a stage 47 of the column C1, which is the fifth stage starting from the highest stage of the column.

The first bottom fraction 4 from the flask B1, whose rate of flow is 1224 kmol/h, and which comprises 54.27 mol % methane and 13.24 mol % ethane, undergoes pressure reduction to a pressure of 40.0 bar, and is then heated in the exchanger E1 from −52.98° C. to −38.00° C., to obtain the fraction 29. This fraction is introduced into the separation flask B2.

The top fraction 7 from the flask B2 whose rate of flow is 439 kmol/h, and whose ethane content is 6.21 mol %, is cooled and liquefied from −38.00° C. to −101.40° C. to obtain the fraction 31. This fraction then undergoes pressure reduction to 23.2 bar and −101.47° C., and is then introduced into the column C1 at a stage 48, which is the sixth stage starting from the highest stage of the column.

The bottom fraction or lower fraction 8, whose flow rate is 784 kmol/h and whose ethane content is 17.18 mol %, undergoes pressure reduction to 23.2 bar and −46.46° C., and is then introduced into column C1 at a stage 49, which is the twelfth stage starting from the highest stage of the column.

Column C1 produces the top fraction 5 at a pressure of 23 bar and a temperature of −103.71° C. with a flow rate of 15510 kmol/h. This top fraction 5 contains only 0.05 mol % ethane.

The top fraction 5 is heated in the exchanger E1 to provide a fraction 20 at a temperature of 17.96° C. and a pressure of 22.0 bar. This fraction 20 is compressed in the compressor K1 coupled to the turbine T1. The power recovered by the turbine is used to compress the fraction 20 to yield the compressed fraction 21 at a temperature of 38.80° C. and a pressure of 27.67 bar. This latter fraction is then compressed in the principal compressor K2 to yield the fraction 22 at a pressure of 63.76 bar and a temperature of 118.22° C. The compressor K2 is driven by the gas turbine GT. The fraction 22 is then cooled in the air cooler A1 to provide the fraction 23 at a temperature of 40.00° C. and a pressure of 63.06 bar.

Fraction 23 is then separated on the one hand into the main fraction 1 in a proportion of 13510 kmol/h which is then sent to a gas pipeline for delivery to industrial clients, and on the other hand to the branching fraction 6 in a proportion of 2000 kmol/h. Fraction 1 is composed of 99.3849 mol % methane and 0.0481 mol % ethane, 0.0000 mol % propane and higher alkanes, 0.1785 mol % $CO_2$ and 0.3885 mol % $N_2$.

The branching fraction 6 is recycled to the heat exchanger E1 to provide the fraction 24 cooled to −101.40° C. at 62.06 bar. Fraction 24 then undergoes pressure reduction to 23.2 bar and −104.18° C. and is then introduced into column C1 at a stage 50 which is the first stage starting from the highest stage of the column.

At the bottom, column C1 produces the second bottom fraction 2 which contains 99.18% of the ethane contained in the charge of dry natural gas 14, and 100% of the other hydrocarbons initially contained in this charge 14. This fraction 2, available at 19.16° C. and 23.2 bar, contains 3.4365 mol % $CO_2$, 0.0000 mol % $N_2$, 0.5246 mol % methane, 52.4795 mol % ethane, 23.9426 mol % propane, 5.4324 mol % isobutane, 6.6395 mol % n-butane, 2.4144 mol % isopentane, 1.9114 mol % n-pentane, 1.9114 mol % n-hexane, 1.0060 mol % n-heptane, and 0.3018 mol % n-octane.

Column C1 is provided with lateral reboilers in its lower part, which is located below the stage where fraction 8 is introduced, and comprises a number of stages.

Thus, the liquid collected on a tray 52, available at a temperature of −52.67° C. and a pressure of 23.11 bar, located below a stage 51 which is the thirteenth stage starting from the highest stage of the column, is conducted into the lateral reboiler 33. This reboiler constitutes an integrated circuit in the exchanger E1 whose flow rate is 2673 kmol/h. This lateral reboiler 33 has a thermal output of 3836 kW. The liquid collected on the tray 52 is then heated to −19.79° C., and is then sent into column C1 on a tray 53 which corresponds to the bottom of the fourteenth stage, starting from the highest stage of the column. The liquid drawn off tray 52 is made up particularly of 24.42 mol % methane and 44.53 mol % ethane.

Similarly, the liquid collected on a tray 55, available at a temperature of 2.84° C. and a pressure of 23.17 bar, located below a stage 54, which is the nineteenth stage starting from the highest stage of the column, is conducted into the lateral reboiler 34. This reboiler constitutes an integrated circuit in the exchanger E1 whose flow rate is 2049 kmol/h. This lateral reboiler 34 has a thermal output of 1500 kW. The liquid collected on the tray 55 is then heated to 11.01° C. and then sent into column C1 on a tray 56 which corresponds to the bottom of the twentieth stage starting from the highest stage of the column. The liquid drawn off tray 55 is made up particularly of 2.84 mol % methane and 57.29 mol % ethane.

Finally, the liquid collected on a tray 58, available at a temperature of 13.32° C. and a pressure 23.20 bar, located below a stage 57 which is the twenty-second stage, starting from the highest stage of the column, is conducted into the bottom reboiler of the column or the lateral reboiler 35. This reboiler is made up of an integrated circuit in the exchanger E1 whose flow rate is 1794 kmol/h. This lateral reboiler 35 has a thermal output of 1146 kW. The liquid collected on the tray 58, made up particularly of 0.93 mol % methane and 55.89 mol % ethane, is then heated to 19.16° C. and then sent into the bottom of the column C1 in an enclosure 59 which corresponds to the bottom of the twenty-third stage, starting from the highest stage of the column. The liquid leaving tray 58 has the same composition as the bottom product of column 59 and the same as product 2 drawn off from the bottom of column C1.

The assembly of heat exchanges occurs in the cryogenic exchanger E1, which is preferably composed of a series of plate exchangers made of brazed aluminum.

The ethane extraction process using an installation according to FIG. 2 makes it possible to recover more than 99% of the ethane contained in natural gas.

According to an operational model of the installation of FIG. 2, the charge of dry natural gas 14, at a temperature of 24° C. and a pressure of 62 bar, whose flow rate is 15,000 kmol/h, and made up of 0.4998 mol % $CO_2$, 0.3499 mol % $N_2$, 89.5642 mol % methane, 5.2579 mol % ethane, 2.3790 mol % propane, 0.5398 mol % isobutane, 0.6597 mol % n-butane, 0.2399 mol % isobutane, 0.6597 mol % n-butane, 0.2399 mol % isopentane, 0.1899 mol % n-pentane, 0.1899 mol % n-hexane, 0.1000 mol % n-pentane, 0.0300 mol % n-octane is cooled and partly condensed in the heat exchanger E1 to −42° C. and 61 bar to form the fraction 18. The liquid and gas phases are separated in flask B1. The first top fraction 3, which is a stream of 13776 kmol/h, is divided into 2 streams:

(a) the main stream 45 with a flow rate of 11471 kmol/h, which undergoes pressure reduction in the turbine T1 to a pressure of 23.20 bar. The dynamic expansion makes it possible to recover 3087 kW of energy and makes it possible to cool this stream to a temperature of −83.41° C. This stream 19, which is partly condensed, is sent to column C1. It enters this column on a stage 46 which is the tenth stage starting from the highest stage of column C1. Its entry pressure is 23.05 bar and its temperature is −83.57° C.

(b) the secondary stream 9, at a flow rate of 2305 kmol/h, which is liquefied and cooled to −62.03° C. in the exchanger E1 to form the fraction 26. This fraction 26 which includes 4.5 mol % ethane undergoes pressure reduction to 46 bar to a temperature of −72.68° C. and then is introduced into the third separating flask B3 in which the vapor and liquid phases are separated into the fourth top fraction 10 and the fourth bottom fraction 11.

The fourth top fraction 10, whose rate of flow is 1738 kmol/h, includes 96.15 mol % methane and 2.61 mol % ethane. The latter is then liquefied and cooled to −101.4° C. in the exchanger E1 to yield the fraction 40. Fraction 40 then undergoes pressure reduction to 23.2 bar to a temperature of −102.99° C., and is introduced into column C1 at a stage 47 which is the fifth stage starting from the highest stage of the column.

The fourth bottom fraction 11, whose rate of flow is 567 kmol/h, includes 82.11 mol % methane and 10.48 mol % ethane. This is then heated in the exchanger E1 to a temperature of −55.00° C. and a pressure of 44.50 bar, and is then introduced into the fourth separating flask B4 where the liquid and gas phases are separated into the fifth top fraction 12 and the fifth bottom fraction 13.

The fifth top fraction 12, whose rate of flow is 420 kmol/h, includes 91.96 mol % methane and 6.05 mol % ethane. This is then liquefied and cooled to a temperature of −101.4° C. in the exchanger E1 to yield the fraction 43. The fraction 43 then undergoes pressure reduction to 23.2 bar to a temperature of −101.57° C. and is introduced into column C1 at a stage 61 which is the sixth stage starting from the highest stage of the column.

The fifth bottom fraction 13, whose rate of flow is 146 kmol/h, includes 53.85 mol % methane and 23.22 mol % ethane. The latter is then mixed with the first bottom fraction 4 to yield the fraction 63. Fraction 63 is then heated in the exchanger E1 from −53.70° C. to −38.00° C. at a pressure of 39.5 bar to yield the fraction 29.

The first bottom fraction 4 of the flask B1 whose rate of flow is 1224 kmol/h and which includes 13.24 mol % ethane undergoes pressure reduction to a pressure of 40 bar before it is mixed with the fraction 13.

Fraction 29 is then introduced into the separation flask B2. The top fraction 7 from the flask B2 whose rate of flow is 494 kmol/h and whose ethane content is 6.72 mol %, is cooled and liquefied from −38° C. to −101.4° C., to obtain the fraction 31. The latter then undergoes pressure reduction to 23.2 bar, and is then introduced into the column C1 at a stage 48 which is the seventh stage starting from the highest stage of the column.

The bottom or lower fraction 8, whose rate of flow is 876 kmol/h and whose ethane content is 18.58 mol %, undergoes pressure reduction to 23.2 bar and −46.76° C., is then introduced into column C1 at a stage 49 which is the twelfth stage starting from the highest stage of the column.

Column C1 produces the top fraction 5 at a pressure of 23 bar and a temperature of −103.61° C., with a rate of flow of 15308 kmol/h. This top fraction 5 contains only 0.05 mol % ethane.

The top fraction 5 is heated in the exchanger E1 to provide the fraction 20 at a temperature of 17.48° C. and a pressure of 22 bar. This fraction 20 is compressed in the compressor K1 coupled to the turbine T1. The power recovered by the turbine is used to compress fraction 20 to yield the compressed fraction 21 at a temperature of 38.61° C. and a pressure of 27.76 bar. The latter fraction is then compressed in the main compressor K2 to yield the fraction 22 at a pressure of 63.76 bar and a temperature of 117.7° C. The compressor K2 is driven by the gas turbine GT. The fraction 22 is then cooled in the air cooler A1 to provide the fraction 23 at a temperature of 40.00° C. and a pressure of 63.06 bar.

Fraction 23 is then separated, on the one hand, into the main fraction 1 in a proportion of 13517 kmol/h, which is then send to a gas pipeline for delivery to industrial clients, and on the other hand into the branching fraction 6 in a proportion of 1790 kmol/h. Fraction 1 is composed of 99.3280 mol % methane and 0.0485 mol % ethane, 0.0000 mol % propane and higher alkanes, 0.2353 mol % $CO_2$ and 0.3882 mol % $N_2$.

The branching fraction 6 is recycled to the heat exchanger E1 to provide the fraction 24 cooled to −101.4° C. at a pressure of 62.06 bar. Fraction 24 then undergoes pressure reduction to 23.2 bar with a temperature of −104.17° C. and is then introduced into column C1 at a stage 50, which is the first stage starting from the highest stage of the column.

At the bottom, column C1 produces the second bottom fraction 2 which contains 99.18% of the ethane contained in the charge of dry natural gas 14, and 100% of the other hydrocarbons initially contained in this charge 14. This fraction 2, available at 19.90° C. and 23.2 bar, contains 2.9129 mol % $CO_2$, 0.0000 mol % $N_2$, 0.5274 mol % methane, 52.7625 mol % ethane, 24.0733 mol % propane, 5.4620 mol % isobutane, 6.6758 mol % n-butane, 2.4276 mol % isopentane, 1.9218 mol % n-pentane, 1.9218 mol % n-hexane, 1.0115 mol % n-heptane, and 0.3034 mol % n-octane.

Column C1 is provided with lateral reboilers in its lower part, which is located below the stage where fraction 8 is introduced, and comprises a number of stages.

Thus, the liquid collected on a tray 52, available at a temperature of −51.37° C. and a pressure of 23.11 bar, located below a stage 51, which is the thirteenth stage starting from the highest stage of the column, is conducted into the lateral reboiler 33. This reboiler is made up of an integrated circuit in the exchanger E1 whose rate of flow is 2560 kmol/h. This lateral reboiler 33 has a thermal output of 3465 kW. The liquid collected on the tray 52 is then heated to −19.80° C. and sent into the column C1 on a tray 53 which corresponds to the bottom of the fourteenth stage starting from the highest stage of the column. The liquid drawn off the tray 52 is made up particularly of 23.86 mol % methane and 45.10 mol % ethane.

Similarly, the liquid collected on a tray 55, available at a temperature of 3.48° C. and a pressure of 23.17 bar, located below a stage 54, which is the nineteenth stage starting from the highest stage of the column, is conducted into the lateral reboiler 34. This reboiler is made up of an integrated circuit in the exchanger E1, whose rate of flow is 2044 kmol/h. This lateral reboiler 34 has a thermal output of 1500 kW. The liquid collected on the tray 55 is then heated to 11.71° C. and then sent into column C1 on a tray 56 which corresponds to the bottom of the twentieth stage staffing from the highest stage of the column. The liquid present on tray 55 is made up particularly of 2.92 mol % methane and 57.92 mol % ethane.

Finally, the liquid collected on a tray 58, available at a temperature of 14.09° C. and a pressure of 23.20 bar, located below a stage 57, which is the twenty-second stage starting from the highest stage of the column, is conducted into the bottom reboiler of the column or lateral reboiler 35. The latter is made up of an integrated circuit in the exchanger E1, whose rate of flow is 1788 kmol/h. This lateral reboiler 35 has a thermal output of 1147 kW. The liquid collected on the tray 58 is then heated to 19.90° C. and is then sent into the bottom 59 of column C1. The liquid drawn off tray 58 is made up particularly of 0.94 mol % methane and 56.35 mol % ethane.

When an installation according to the process described in FIG. 2 is used, for an ethane recovery identical to that obtained with the use of an installation according to FIG. 1, a decrease in the power for the compressor K2 from 12355 kW to 12130 kW is obtained. Similarly, a decrease in the flow rate of the gas recycled in the circuit comprising fraction 6 from 2000 kmol/h to 1790 kmol/h makes it possible to decrease the heat exchange for cooling of fraction 6 to obtain fraction 24.

There is also a reduction in the carbon dioxide content of the cut $C_2$+:

According to FIG. 1: 3.4365 mol %

According to FIG. 2: 2.9129 mol %

This lower level of $CO_2$ thus facilitates further treatment relative to at least partial elimination of the carbon dioxide present in the $C_2$ cut, drawn off from the bottom of column C1.

Therefore, the invention is of interest for limiting energy use in the production of purified gases. This goal is attained with great selectivity of separation of methane and the other constituents when the process is implemented.

Thus, the results obtained by the invention offer significant advantages, consisting of simplification and substantial savings in the embodiment and the technology, as well as the methods for using them and the quality of the products obtained by these methods.

What is claimed is:

1. A process for separation of a mixture cooled under pressure, containing methane and $C_2$ and higher hydrocarbons, into a methane-rich light fraction and a final heavy fraction rich in $C_2$ and higher hydrocarbons, the process comprising:

in a first stage, cooling the mixture under pressure, separating the mixture, in a first flask, into a relatively more volatile first top fraction and a relatively less volatile first bottom fraction, introducing the first bottom fraction into a middle part of a distillation column, collecting in the lower part of the distillation column, the heavy fraction rich in $C_2$ and higher hydrocarbons as a second bottom fraction, introducing, after pressure reduction in a turbine, the first top fraction, in an upper part of the distillation column, collecting, in an upper part of the distillation column, a second methane-rich top fraction, compressing and cooling the second top fraction to produce the light fraction, and taking a first sample fraction from the light fraction;

in a second stage, cooling and liquefying the first sample fraction, and introducing the cooled and liquefied first sample fraction into the upper part of the distillation column; and in a third stage, subjecting the first bottom fraction to a number of sub-stages including heating, passage into a second flask, and separation into a relatively more volatile third top fraction, and a relatively less volatile third bottom fraction, introducing the third bottom fraction into the middle part of the distillation column, cooling and liquefying a third top fraction, and introducing the cooled and liquefied third top fraction, after cooling and liquefaction, into the upper part of the distillation column.

2. The process according to claim 1, including removing a second sample fraction from the first top fraction, cooling and liquefying the second sample, and introducing the cooled and liquefied second sample fraction into the upper part of the distillation column.

3. The process according to claim 2, including:

cooling and partly condensing the second sample fraction, separating the second sample fraction in a third flask into a fourth relatively more volatile top fraction, cooling, liquefying, and introducing the fourth volatile top fraction into the upper part of the distillation column, heating and separating a fourth relatively less volatile bottom fraction in a fourth flask into a fifth relatively more volatile top fraction, cooling and introducing the fifth top fraction into the upper part of the distillation column, and heating a fifth relatively less volatile bottom fraction and sending the fifth bottom fraction into said second flask.

4. The process according to claim 3, wherein the upper part of the distillation column comprises at least two successive stages, the first of the two successive stages being the lowest, and including introducing the fifth top fraction above the first of the two successive stages.

5. The process according to claim 3, wherein the upper part of the distillation column comprises at least three successive stages, the first of the three successive stages being the lowest, and including introducing the fourth top fraction above the second of the three successive stages.

6. The process according to claim 2, wherein the upper part of the distillation column comprises at least two successive stages, the first of the two successive stages being the lowest, and including introducing the second sample fraction above the first of the two successive stages.

7. The process according to claim 6, including introducing the third top fraction in the first stage of the upper part of the distillation column.

8. The process according to claim 1, wherein the lower part of the distillation column comprises a number of stages connected, in pairs, to at least one lateral reboiler.

9. The process according to claim 1, including heating and compressing, the second top fraction, after it leaves the distillation column, to produce the methane-rich light fraction.

10. The process according to claim 1, wherein the upper part of the distillation column comprises at least three stages, the first of the three stages being the lowest, including introducing the first sample fraction in a lower part of the last of the three stages, and introducing the third top fraction below the last of the three stages.

11. The process according to claim 1, wherein the middle part of the distillation column comprises at least two successive stages, the first of the two successive stages being the lowest, and introducing the third bottom fraction into the first of the two successive stages, and introducing the first top fraction above the first of the two successive stages.

12. An apparatus for separation of a mixture cooled under pressure containing methane and $C_2$ and higher hydrocarbons, into a methane-rich light fraction and a heavy fraction rich in $C_2$ and higher hydrocarbons, comprising:

in a first stage including a distillation column in which the mixture cooled under pressure is present, means for separating the mixture, in a first flask, into a relatively more volatile first top fraction and a relatively less volatile first bottom fraction, the first bottom fraction being introduced into a middle part of the distillation column in which, in a lower part of the column, the final heavy fraction rich in $C_2$ and higher hydrocarbons are collected as the second bottom fraction, a turbine reducing pressure of the first top fraction for introducing, after the pressure reduction, the first top fraction into an upper part of the distillation column, for collecting a second methane-rich top fraction in the upper part of the distillation column, a compressor and cooler for compressing and cooling the second top fraction to produce the light fraction, and for taking a first sample fraction from the light fraction;

means, in a second stage, for introducing the first sample fraction, after cooling and liquefaction, into the upper part of the distillation column; and in a third stage, means for subjecting the first bottom fraction to heating, passage into a second flask, and separation into a relatively more volatile third top fraction and a relatively less volatile third bottom fraction, wherein the third bottom fraction is introduced into the middle part of the distillation column, and the third top fraction is introduced into the upper part of the distillation column, after cooling and liquefaction.

* * * * *